US008115616B2

(12) United States Patent
Gonzaga

(10) Patent No.: US 8,115,616 B2
(45) Date of Patent: Feb. 14, 2012

(54) GARAGE DOOR ALERT EMPLOYING A GLOBAL POSITIONING SYSTEM

(75) Inventor: John S. Gonzaga, Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 350 days.

(21) Appl. No.: 12/429,574

(22) Filed: Apr. 24, 2009

(65) Prior Publication Data

US 2010/0271193 A1 Oct. 28, 2010

(51) Int. Cl.
*G08B 21/00* (2006.01)

(52) U.S. Cl. ..... 340/457; 340/5.71; 340/539.13

(58) Field of Classification Search ..... 340/457, 340/5.71, 3.1, 3.71, 539.1, 539.11, 539.13, 340/932.2; 49/25; 318/16
See application file for complete search history.

(56) References Cited

U.S. PATENT DOCUMENTS

2003/0174045 A1* 9/2003 Zhang ..... 340/5.64
2006/0202815 A1* 9/2006 John ..... 340/531

* cited by examiner

*Primary Examiner* — Jeffery Hofsass
(74) *Attorney, Agent, or Firm* — Ingrassia Fisher & Lorenz, P.C.

(57) ABSTRACT

Methods and systems are provided for alerting a vehicle driver that an automatic garage door has been left open. The system includes an onboard transmitter for activating the automatic garage door; a GPS receiver; an alert device; and an onboard processor. The onboard processor is coupled to the onboard transmitter, the GPS receiver, and to the alert device. The onboard processor is configured to monitor a distance between the vehicle and the predetermined location. The onboard processor activates the alert device if the distance exceeds a predetermined distance.

19 Claims, 2 Drawing Sheets

GARAGE DOOR ALERT EMPLOYING A GLOBAL POSITIONING SYSTEM

TECHNICAL FIELD

This generally relates to vehicle alert systems, and more particularly relates to a system for alerting a driver that a garage door has been left open.

BACKGROUND

Automatic garage doors are now typically opened and closed by means of an onboard transmitter activated by a driver of a vehicle. Commonly, a driver of a vehicle may forget to activate the remote transmitter to close the garage door thus increasing the risk of an unwanted intrusion. Even more commonly, a driver may question if they closed the garage door, often necessitating a return trip to check.

Accordingly, it is desirable to provide a method and system for alerting the driver of a vehicle that the garage door has been left open. Furthermore, other desirable features and characteristics will become apparent from the subsequent detailed description and the appended claims, taken in conjunction with the accompanying drawings and the foregoing technical field and background.

SUMMARY

A system is provided for alerting a vehicle driver that an automatic garage door is left open. The system comprises an onboard transmitter for activating the automatic garage door; a GPS receiver; an alert device; and an onboard processor. The onboard processor is coupled to the onboard transmitter, the GPS receiver, and to the alert device. The onboard processor is configured to monitor a distance between the vehicle and the predetermined location. The onboard processor activates the alert device if the distance exceeds a predetermined distance.

A method is provided for alerting a driver of a vehicle that an automatic garage door on a garage has not been closed. The automatic garage door may be closed using an onboard transmitter on the vehicle. The method comprises determining a distance of the vehicle from the garage; and comparing the distance of the vehicle from the garage with a predetermined distance. The method also includes activating an alert device when the distance of the vehicle from the garage is at least the predetermined distance.

DESCRIPTION OF THE DRAWINGS

A more complete understanding of the subject matter may be derived by referring to the detailed description and claims when considered in conjunction with the following figures, wherein like numerals denote like elements.

DESCRIPTION OF AN EXEMPLARY EMBODIMENT

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

A vehicle in an exemplary embodiment includes an onboard remote transmitter and generates an alert for the driver of the vehicle when the vehicle travels beyond a predefined distance from the garage and the onboard remote transmitter is not activated. In one embodiment an onboard GPS receiver is used to determine the vehicle's home location; i.e. the location of the garage. The onboard GPS receiver is also used to determine when the vehicle has left the predefined distance from the garage.

Figure 1:
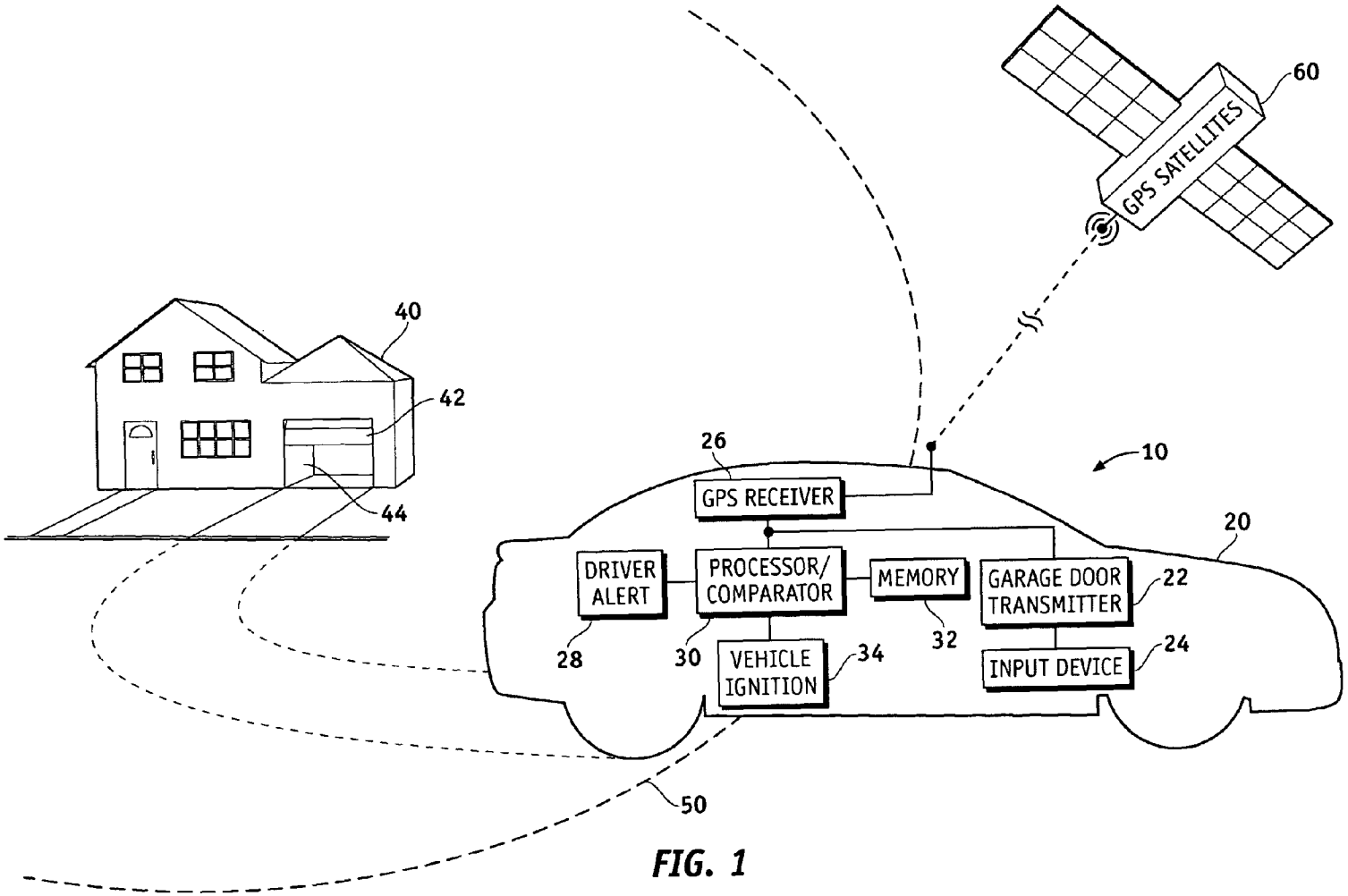
FIG. 1 is a simplified diagram of an exemplary system for alerting a driver of a vehicle that a garage door has not been closed.

FIG. 1 is a block diagram of a system 10 for alerting a driver (not shown) when an automatic garage door 42 has been left open. In the exemplary embodiment, system 10 is implemented in a vehicle 20 and suitably includes a processor 30 (or comparator) having a first input coupled to receive GPS information from GPS receiver 26, a second input coupled to vehicle ignition 34 for receiving an indication that vehicle ignition is activated, a third input coupled to memory module 32 for receiving stored values, and a fourth input coupled to onboard transmitter 22 for receiving an indication when onboard transmitter 22 is activated. Processor 30 has a first output coupled to memory module 32 for storing values, and a second output coupled to activate driver alert device 28. Onboard transmitter 22 sends a signal to activate automatic garage door 42. GPS receiver 26 receives location information signals transmitted from GPS satellites 60.

In the exemplary embodiment processor 30 uses the location information from GPS receiver in at least two ways. First, processor 30 determines if vehicle 20 is starting at garage 44. Second, if vehicle 20 is starting at garage 44, processor 30 tracks how far vehicle 20 is from garage 44, up to a predetermined distance. When vehicle 20 reaches the predetermined distance from garage 44, processor 30 determines if onboard transmitter 22 has sent a signal to close automatic garage door 42. If a signal to close the garage door has not been sent, then processor 30 alerts the driver that the garage door is open using driver alert device 28.

If vehicle 20 is not at garage 44 when the vehicle starts, then processor 30 determines that a garage-door-open alert is not needed. In this case, processor 30 compares a stored location for the location of garage 44 with the starting location when vehicle ignition 34 is activated. Processor 30 determines a distance between the stored location of garage 44 and the starting location of vehicle 20, which distance is ideally zero if vehicle 20 is in garage 44 when vehicle ignition 34 is activated. Due to non-ideal conditions, a threshold distance is used to determine if vehicle 20 is starting in garage 44; so that if the distance between the stored location of garage 44 and the starting location is less than the threshold distance, then processor 30 determines that vehicle 20 is starting in garage 44.

After processor 30 determines that vehicle is starting at garage 44, location information from GPS receiver is used to track the distance between vehicle 20 and garage 44, up to a predetermined distance 50. FIG. 1 illustrates predetermined distance 50 as a broken line representing a distance in all directions from garage 44. Memory module 32 stores the location of garage 44 such as at a home 40. Memory module 32 also stores a distance value as the predetermined distance. Processor 30 receives updates from GPS receiver with a current location, and compares the current location with the stored location of garage 44 to determine a current distance from garage 44. The current distance from garage 44 is then compared with the stored value of predetermined distance 50 to determine if vehicle 20 has reached predetermined distance 50. Processor 30 monitors the vehicle location at regular intervals to determine when vehicle 20 has reached predetermined distance 50.

If onboard transmitter 22 sends a signal to close automatic garage door 42 before vehicle 20 reaches predetermined distance 50, then processor 30 determines that the garage-door-open alert is not needed.

In the exemplary embodiment onboard transmitter 22 has a signal transmission range, and when onboard transmitter is within the signal transmission range it can activate automatic garage door 42. Predetermined distance 50 is a distance that is less than the distance of the signal transmission range; so that onboard transmitter 22 can activate automatic garage door 42 when vehicle 20 has reached predetermined distance 50.

Driver alert device 28 communicates the garage-door-open alert to the driver using indicators such as lights, images, sounds, or vibrations. In this manner driver alert device 28 produces an audible alarm, an audible voice prompt, a visual alert, or a tactile stimulation alert. The garage-door-open alert continues for a set interval, unless the driver activates onboard transmitter 22 by pressing transmitter user input device 24, or the driver cancels the garage-door-open alert.

Figure 2:
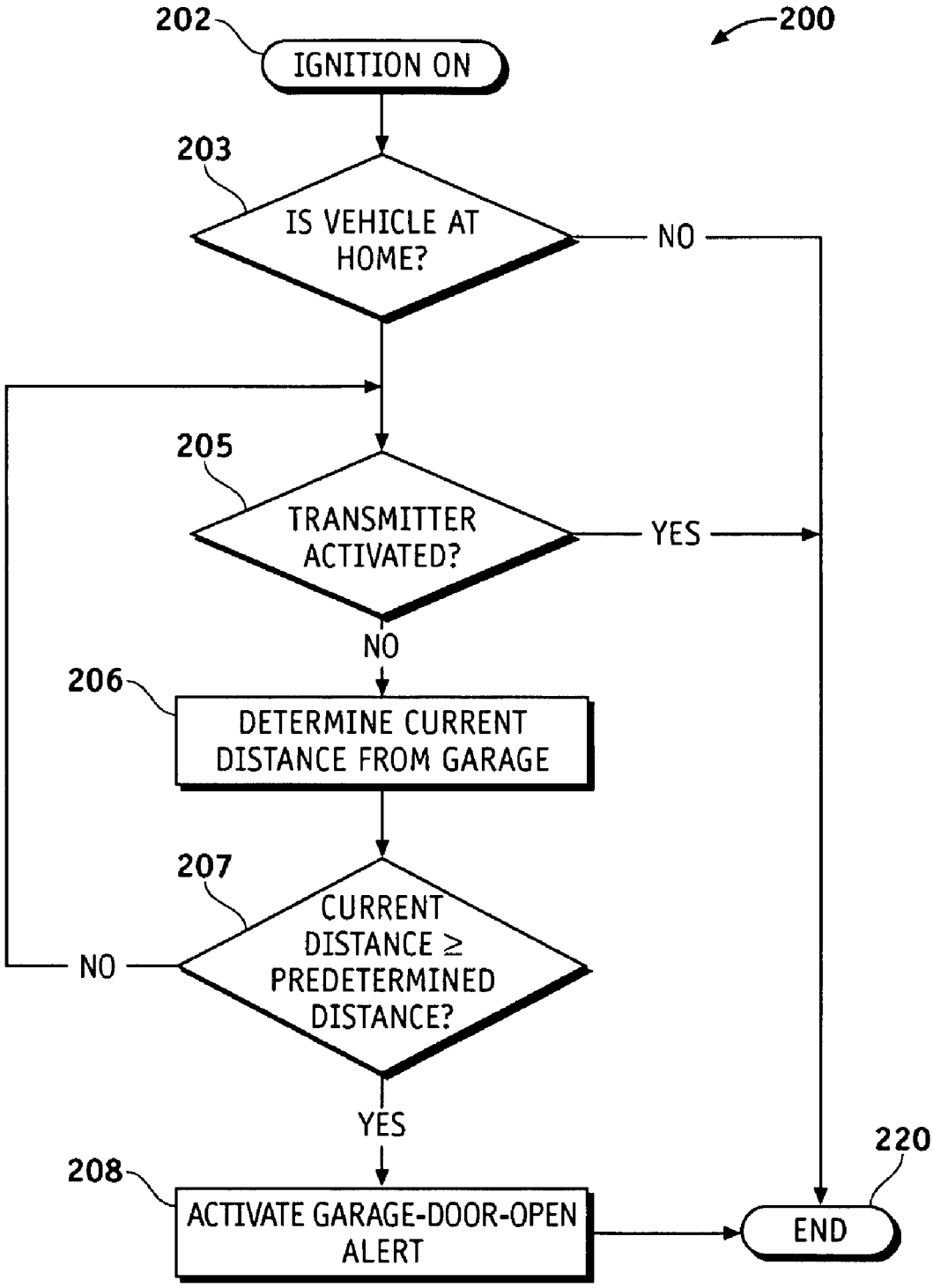
FIG. 2 is a flow chart of an exemplary method of alerting the driver of the vehicle that the garage door has not been closed.

Turning now to FIG. 2, an exemplary method 200 for alerting a driver that automatic garage door 42 (FIG. 1) is open suitably includes the broad functions of determining the current distance of vehicle 20 from garage 44 (function 206), and activating a garage-door-open alert (function 208). Other embodiments additionally determine if the vehicle is at home (function 203), determine if onboard transmitter 22 has been activated (function 205), and determine if the current distance from garage 44 is at least equal to the predetermined distance (function 207). Various other functions and other features may also be provided, as described in increasing detail below.

In the exemplary embodiment, method 200 begins when vehicle ignition 34 (FIG. 1) is activated (function 202). Processor 30 receives a signal indicating vehicle ignition 34 was activated, and begins a process to alert the vehicle operator if the garage door is left open. GPS receiver 26 then sends the starting vehicle location to processor 30. Memory module 32 stores the starting vehicle location, and also stores the location of garage 44. If the stored location of garage 44 is substantially equal to the starting vehicle location, then processor 30 determines that vehicle 20 is at home (function 203) and the exemplary process continues. If the vehicle is not at home (function 203), then the exemplary process ends (function 220).

When vehicle 20 (FIG. 1) is at home 40, processor 30 monitors onboard transmitter to determine if it is activated (function 205). When onboard transmitter 22 is activated, processor 30 ends the process of alerting the driver (function 220).

In exemplary method 200, memory module 32 (FIG. 1) stores the garage location and processor 30 receives updates from GPS receiver with a current vehicle location. Processor 30 compares the stored starting location with the current vehicle location to determine the current distance of vehicle 20 from the garage location (function 206). The current distance from the garage location is compared with a stored predetermined distance (function 207). If the current distance of the vehicle is less than the predetermined distance (function 208), then the driver has not left the area near garage 44 within predetermined distance 50, and may still activate onboard transmitter 22 to close automatic garage door 42. Therefore, processor 30 continues to monitor onboard transmitter (function 205) and determine the current distance from the garage (function 206).

If the current distance from garage 44 (FIG. 1) is equal to or larger than the predetermined distance (function 207), processor 30 activates the garage-door-open alert (function 208). In the exemplary embodiment the garage-door-open alert stops if the driver presses the transmitter input device 24 for onboard transmitter 22. Exemplary method 200 then ends (function 220).

In other embodiments processor 30 may perform the functions described in method 200 in a different order and may execute functions simultaneously. Additional functions may be added or removed, and method 200 may be part of a larger process, or multiple processes.

Generally speaking, the various functions and features of method 200 may be carried out with any sort of hardware, software and/or firmware logic that is stored and/or executed on any platform. Some or all of method 200 may be carried out, for example, by logic executing within vehicle 20 in FIG. 1. In one embodiment, processor 30 executes software logic that performs each of the various functions shown in FIG. 2. Such logic may be stored in memory module 32 or in any other storage available to processor 30 as desired. Hence, the particular logic and hardware that implements any of the various functions shown in FIG. 2 may vary from context to context, implementation to implementation, and embodiment to embodiment in accordance with the various features, scenarios and structures set forth in this application. The particular means used to implement each of the various functions shown in FIG. 2, then, could be any sort of processing structures that are capable of executing conventional software logic in any format. Such processing hardware may include processor 30 or other components of vehicle 20, as well as any other processors or other components associated with any conventional vehicle, GPS receiver, ignition system, vehicle display and/or the like. Processor 30, for example, may be a comparator that is configured to compare values and to produce a result based on the comparison. In one embodiment a comparator is implemented in a processor. In other embodiments, a comparator is implemented with other suitable devices.

While at least one exemplary embodiment has been presented in the foregoing detailed description, it should be appreciated that a vast number of variations exist. Processor 30, for example, may determine that the process should end at any time, for example, if onboard transmitter 22 sends a signal to close automatic garage door 42. Alternatively, processor 30 may determine whether to end the process of alerting the driver at the time when the vehicle reaches the predetermined distance from garage 44. Processor 30 may determine the current distance of vehicle 20 from garage 44 by comparing the current location to the starting location, rather than the location of garage 44. Many methods may be used to determine a starting location; as an alternative to receiving a signal from vehicle ignition 34, processor 30 may receive a signal from a sensor to determine when a motor or an engine is started, and therefore determine the starting location. Additionally, the process of alerting the driver, including determining a starting location, may be part of a start-up routine for processor 30.

It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

The above description refers to elements or features being "connected" or "coupled" together. As used in this application, "connected" may refer to one element/feature being directly joined to (or directly communicating with) another element/feature, and not necessarily mechanically. Likewise, "coupled" may refer to one element/feature being directly or indirectly joined to (or directly or indirectly communicating with) another element/feature, and not necessarily mechanically. However, it should be understood that although two elements may be described above, in one embodiment, as being "connected," in alternative embodiments similar elements may be "coupled," and vice versa. Thus, although the schematic diagrams shown in the drawings depict example arrangements of elements, additional intervening elements, devices, features, or components may be present in an actual embodiment. It should also be understood that FIGS. 1-2 are merely illustrative and may not be drawn to scale.

What is claimed is:

1. A system for alerting a driver of a vehicle that an automatic garage door at a predetermined location has not been signaled to close, the system comprising:

an ignition system for starting an engine of the vehicle;

an onboard transmitter for activating the automatic garage door;

a GPS receiver for determining a current location of the vehicle responsive to the starting of the engine;

a processor coupled to the GPS receiver for comparing the current location with the predetermined location and determining whether the vehicle is approximately at the predetermined location when the engine was started;

an alert device; and an onboard processor coupled to the onboard transmitter, the GPS receiver, and to the alert device, the onboard processor configured to monitor a distance between the vehicle and the predetermined location when the engine was started approximately at the predetermined location, and to activate the alert device if the distance reaches a predetermined distance from the predetermined location and the onboard transmitter has not been activated to close the automatic garage door.

2. A system according to claim 1 wherein the onboard processor activates the alert device for a time period or until the onboard transmitter has been activated to close the automatic garage door.

3. A system according to claim 1 wherein the onboard processor discontinues monitoring the distance between the vehicle and the predetermined location after the onboard transmitter has been activated.

4. A system according to claim 1 wherein the alert device is configured to produce one or more of: an audible alarm; an audible voice prompt; a visual alert; or a tactile stimulation alert.

5. A system for alerting a driver of a vehicle that an automatic garage door at a predetermined location has not been signaled to close; the system comprising:

an ignition system for starting an engine of the vehicle;

an onboard transmitter for activating the automatic garage door;

a GPS receiver for determining a current location of the vehicle responsive to the starting of the engine;

a comparator coupled to the GPS receiver for comparing the current location with the predetermined location and determining whether the vehicle is approximately at the predetermined location; and an alert device coupled to the comparator and to the onboard transmitter for generating an alert when the engine was started at approximately the predetermined location and the the vehicle has traveled at least a predetermined distance from the predetermined location and the onboard transmitter has not initiated the closing of the automatic garage door.

6. A system according to claim 5 wherein:

the alert device is configured to generate the alert for a time period when the current location is at least the predetermined distance or until the onboard transmitter has been activated .

7. A system according to claim 5 wherein the alert device is configured to produce an audible alarm.

8. A system according to claim 5 wherein the alert device is configured to produce an audible voice prompt.

9. A system according to claim 5 wherein the alert device is configured to produce a visual alert.

10. A system according to claim 5 wherein the alert device is configured to produce a tactile stimulation alert.

11. A system according to claim 5 wherein the onboard transmitter is configured to transmit to the automatic garage door within a transmission range, and wherein the transmission range is greater than the predetermined distance.

12. A method of alerting a driver of a vehicle that an automatic garage door on a garage has not been signaled to close using an onboard transmitter for activating the automatic garage door, the method comprising:

detecting activation an ignition system of the vehicle;

determining a current location of the vehicle;

comparing the current location of the vehicle to a stored garage location and determining whether the vehicle is starting approximately at the stored garage location; and when it is determined that the vehicle is starting approximately at the stored garage location:

determining a distance of the vehicle from the garage;

comparing the distance of the vehicle from the garage with a predetermined distance; and activating an alert device when the distance of the vehicle from the garage is at least the predetermined distance and the onboard transmitter has not signaled the closing of the automatic garage door.

13. A method according to claim 12 further comprising:

activating the alert device for a time period or until the closing of the automatic garage door has been initiated.

14. A method according to claim 12, wherein comparing the distance of the vehicle from the garage further comprises comparing the distance of the vehicle from the garage until the onboard transmitter has signaled the closing of the automatic garage door.

15. A method according to claim 12 wherein the vehicle includes a GPS receiver, and wherein determining the distance from the garage further comprises receiving a current vehicle location from the GPS receiver.

16. A method according to claim 12, wherein activating the alert device comprises activating an audible alarm.

17. A method according to claim 12, wherein activating the alert device comprises activating an audible voice prompt.

18. A method according to claim 12, wherein activating the alert device comprises activating a visual alert.

19. A method according to claim 12, wherein activating the alert device comprises activating a tactile stimulation alert.

* * * * *